US005215855A

United States Patent [19]

Keoshkerian et al.

[11] Patent Number: 5,215,855

[45] Date of Patent: Jun. 1, 1993

[54] ENCAPSULATED TONER COMPOSITIONS

[75] Inventors: Barkev Keoshkerian, Thornhill; Beng S. Ong, Mississauga, both of Canada

[73] Assignee: Xerox Corporation, Stamford, Conn.

[21] Appl. No.: 790,861

[22] Filed: Nov. 12, 1991

[51] Int. Cl.[5] ..... G03G 9/093

[52] U.S. Cl. ..... 430/138; 430/99; 430/126

[58] Field of Search ..... 430/109, 110, 138, 99, 430/126

[56] References Cited

U.S. PATENT DOCUMENTS

| | | | |
|---|---|---|---|
| 4,565,773 | 1/1986 | Matrick | 430/331 |
| 4,585,723 | 4/1986 | Kishi et al. | 430/106 |
| 4,640,881 | 2/1987 | Dennis | 430/106.6 |
| 4,758,491 | 7/1988 | Alexandrovich et al. | 430/110 |
| 4,876,169 | 10/1989 | Gruber et al. | 430/110 |
| 4,902,570 | 2/1990 | Heinemann et al. | 428/405 |
| 4,954,408 | 9/1990 | Georges | 430/108 |
| 5,023,159 | 6/1991 | Ong et al. | 430/109 |

*Primary Examiner*—John Goodrow
*Attorney, Agent, or Firm*—E. O. Palazzo

[57] ABSTRACT

An encapsulated toner composition comprised of a core comprised of polymer resins, and colorants, which core is encapsulated within a polymer shell containing a siloxane component.

23 Claims, No Drawings

ENCAPSULATED TONER COMPOSITIONS

BACKGROUND OF THE INVENTION

The present invention is generally directed to toner compositions, and more specifically to encapsulated toner compositions and processes thereof. In one embodiment, the present invention is related to encapsulated toner compositions comprised of core components such as, for example, polymer resins, and colorants comprised of magnetic pigments, dyes, color pigments like cyan, magenta, yellow, red, green, blue, brown, or mixtures thereof, and thereover a polymeric shell containing a siloxane component. Another embodiment of the present invention relates to encapsulated toners comprised of a core containing a polymer resin, or plurality of polymer resins and magnetic pigment particles, such as iron oxides or magnetites, encapsulated within a polymeric shell, preferably comprised of a condensation polymer which has been chemically treated with a silane reagent. The encapsulated toners of the present invention in embodiments possess a number of advantages including cold pressure fixability, low heat fusibility, high image fix, excellent powder flow characteristics, excellent surface release properties, and excellent toner shelf stability.

Encapsulated toners and processes thereof are known. For example, both U.S. Pat. No. 4,626,489 and British Patent Publication 1,538,787 disclose similar processes for colored encapsulated toners wherein both the core resin and shell materials are prepared by free radical polymerization techniques. U.S. Pat. No. 4,565,764 discloses a colored microcapsule toner comprised of a colored core encapsulated by two resin shells with the inner shell having an affinity for both the core and the outer shell materials, and U.S. Pat. No. 4,254,201 illustrates the use of pressure sensitive toner clusters or aggregates with each granule of the cluster or aggregate being comprised of a pressure sensitive adhesive substance encapsulated by coating film. Color pigment particles or magnetic particles can be present on the surfaces of the encapsulated granules to impart the desired color to the toners. Also, U.S. Pat. No. 4,727,011 discloses a process for preparing encapsulated toners which involves a shell forming interfacial polycondensation and a core binder forming free radical polymerization, and further U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other prior art, all U.S. patents, are summarized below: U.S. Pat. No. 4,339,518, which relates to a process of electrostatic printing with fluorinated polymer toner additives where suitable materials for the dielectric toner are thermoplastic silicone resins and fluorine containing resins having low surface energy, reference column 4, beginning at line 10, note for example the disclosure in column 4, line 16, through column 6; U.S. Pat. No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18; U.S. Pat. No. 4,265,994 directed to pressure fixable capsule toners with polyolefins, such as polytetrafluoroethylene, see for example column 3, beginning at line 15; U.S. Pat. No. 4,497,885, which discloses a pressure fixable microcapsule toner comprising a pressure fixable component, a magnetic material, and other optional components, and wherein the core material can contain a soft material, typical examples of which include polyvinylidenefluoride, polybutadiene, and the like, see column 3, beginning at line 10; U.S. Pat. No. 4,520,091 discloses an encapsulated toner with a core which comprises a colorant, a dissolving solvent, a nondissolving liquid and a polymer, and may include additives such as fluorine containing resin, see column 10, beginning at line 27; U.S. Pat. No. 4,590,142 relating to capsule toners wherein additives such as polytetrafluoroethylenes are selected as lubricating components, see column 5, beginning at line 52; U.S. Pat. Nos. 4,599,289 and 4,803,144.

With further specific reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

In a patentability search report, there were recited the following U.S. patents: U.S. Pat. No. 4,565,733 wherein there is coated unencapsulated toners with a siloxane copolymer to impart clean up qualities thereof, see the Abstract for example; U.S. Pat. Nos. 4,640,881; 4,758,491; 4,876,169 and 4,954,408, which illustrate the inclusion of siloxane polymers in a toner binder resin; U.S. Pat. Nos. 4,585,723 and 4,902,570, which illustrate generally the coupling of siloxanes to small particles.

The disclosures of all the U.S. patents and other patent documents mentioned herein are totally incorporated herein by reference.

A number of copending applications illustrate various encapsulated toner compositions including, for example, U.S. Pat. Nos. 5,043,240, 5,035,970, 5,037,716, 5,139,915, 5,045,253 5,077,167, U.S. Ser. No. 546,278 U.S. Pat. No. 5,114,819, 5,082,757, U.S. Ser. No. 617,222, U.S. Pat. Nos. 5,023,159 5,013,630, 5,153,089, wherein there is disclosed, for example, a toner composition comprised of a homogeneous or substantially homogeneous mixture of polymer resin or resins, and color pigments, dyes, or mixtures thereof overcoated with a component derived from the condensation of a cellulose polymer with a silane component, the disclosures of each of the aforementioned copending applications and patents being totally incorporated herein by reference.

SUMMARY OF THE INVENTION

It is an object of the present invention to provide encapsulated toner compositions with many of the advantages illustrated herein.

In another object of the present invention there are provided encapsulated toner compositions comprised of a core encapsulated in a polymer shell modified with a silane reagent or compound.

In yet another object of the present invention there are provided encapsulated toner compositions comprised of a core comprised of an addition polymer resin and colorants, a polymeric shell bearing a siloxane component.

It is still another object of the present invention there are provided both pressure fixable and heat fusible encapsulated toners.

A further object of the present invention is to provide encapsulated toners with excellent powder flow characteristics.

An additional object of the present invention is the provision of colored encapsulated toners exhibiting low fusing properties, thus enabling lowering of the fusing temperature thereof.

A further object of the present invention is to provide a simple preparative process for small size toners with narrow size distribution without the need to resort to conventional pulverization and classification techniques.

Also, an additional object of the present invention resides in the provision of encapsulated toners displaying excellent surface release properties without the use of known external surface release agents.

A further object of the present invention is to provide encapsulated toners with excellent toner shelflife stability.

These and other objects of the present invention can be accomplished by the provision of toners, and more specifically encapsulated toners and processes thereof. In one embodiment of the present invention, there are provided encapsulated toners with a core comprised of a polymer resin derived from the free radical polymerization of monomer, or a plurality of monomers, for example up to 5 monomers, an optional preformed polymer resin, and colorants such as dyes, magnetic or color pigment particles, or mixtures thereof, and which core is encapsulated within a polymeric coating containing a siloxane component or overcoated with a siloxane layer. In another embodiment, there are provided, in accordance with the present invention, colored encapsulated toners comprised of a core comprised of a polymer resin derived from free radical polymerization, an optional preformed polymer resin, and colorants; and a condensation polymeric shell chemically treated with a silane reagent, or compound.

Embodiments of the present invention include an encapsulated toner composition comprised of a core comprised of polymer resins, and colorants, which core is encapsulated within a polymer shell containing a siloxane component; an encapsulated toner composition comprised of a core comprised of a polymer resin, pigment particles, and thereover a polymer shell coated with a siloxane component obtained from the hydrolysis and subsequent condensation of an alkoxysilane, halosilane, or disilazane on the shell surface; and a process for the preparation of encapsulated toner compositions which comprises forming a stable oil-in-water microdroplet suspension in an aqueous medium containing a surfactant; effecting a shell-forming interfacial polycondensation, followed by a core resin-forming free radical polymerization within the newly formed microcapsules, thereby converting the microdroplets into encapsulated particles; treating the encapsulated particles with a suitable silane reagent; and thereafter applying optional surface additives to the silane-treated encapsulated particles.

The aforementioned toners of the present invention can be prepared by a simple one-pot process which comprises (1) dispersing a mixture of one or more core monomers, an oil-soluble free-radical initiator or initiators, at least one oil-soluble shell precursor or monomer component, colorants, an optional preformed core resin, such as a styrene polymer, an acrylate polymer, a methacrylate polymer, a polyester, and the like present in an effective amount of, for example, from about 0 to about 50 weight percent of the total core polymers, and an optional diluent, by high shear blending into stabilized microdroplets having an effective specific droplet size and size distribution in an aqueous medium containing a surfactant or stabilizer; (2) initiating the shell-forming interfacial polycondensation by adding one or more water-soluble shell precursors or monomer components; (3) thereafter, effecting the core resin-forming free radical polymerization by heating, leading to the formation of encapsulated toner particles; and (4) treating the resulting encapsulated particles with a silane reagent. The core resin-forming free radical polymerization is generally conducted in a temperature range of from about 35° C. to over about 120° C., and preferably from about 45° C. to about 90° C., for an effective period of time of, for example, from about 1 to about 24 hours, depending primarily on the monomers and free radical initiators used. The core resin obtained via free radical polymerization, together with the optional preformed polymer resin, comprise from about 20 to about 98 percent by weight of toner, the colorant comprising magnetic pigments, dyes, color pigment or mixtures thereof comprising from about 1 to about 60 percent by weight of toner, the shell comprising from about 0.01 to about 20 percent by weight of the toner, while the siloxane component comprises from about 0.001 to about 10 percent by weight of toner in embodiments thereof.

The siloxane component of the present invention in embodiments may or may not be chemically attached to the shell polymer, depending primarily on the nature of shell polymer and its precursors, the silane reagent used, the surfactant or stabilizer utilized during the dispersion process, and the like. It is believed, although not being desired to be limited thereto, that the siloxane component either forms a physical overcoat on the encapsulated particles or is bonded to the shell surface through a Si-O-C linkage with the carbon atom of this linkage being part of the surfactant molecules attached or grafted to the shell. In an embodiment of the present invention, the encapsulated toners are comprised of a core comprised of a polymer resin such as a styrene polymer, an acrylate polymer, a methacrylate polymer, and the like, and a colored pigment, and wherein said core is encapsulated within a polymeric shell comprised of a polyurea, a polyurethane, a polyester, a polyamide, or mixtures thereof; and which shell is overcoated with a siloxane component. The presence of the siloxane component on the shell eliminates or substantially reduce the toner's sensitivity to moisture, enhances the toner's powder flow characteristics, and the like. In addition, the siloxane component also enhances the effectiveness of the shell in retaining the core components such as core resins and colorants. The siloxane component in embodiments also substantially eliminates the need for the toners to contain surface release additives for surface release properties. Another embodiment of the present invention relates to encapsulated toner wherein the toner includes thereon an electroconductive material obtained from a water based dispersion of said electroconductive material in a polymeric binder.

Examples of core resins selected include acrylic, methacrylic, styryl and olefinic polymers. The core resins can be generated by free radical polymerization subsequent to the shell forming interfacial polycondensation. Suitable addition monomers for the core resin-forming free radical polymerization can be selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known colorants including magnetic pigments may be selected for the toner compositions of the present invention providing, for example, that they do not interfere with the shell forming and core resin forming polymerization reactions. Typical magnetic pigments, preferably present in an effective amount of, for example, from about 0.1 to about 60 weight percent of toner, include Mobay magnetites MO8029 TM, MO8060 TM; Columbian MAPICO BLACKS® and surface treated magnetites; Pfizer magnetites CB4799 TM, CB5300 TM, CB5600 TM, MCX636 TM; Bayer magnetites BAYFERROX 8600 TM, 8610 TM; Northern Pigments magnetites, NP-604 TM, NP-608 TM; and Magnox magnetites TMB-100 TM or TMB-104 TM. Typical examples of other colorants inclusive of dyes and color pigments, preferably present in an effective amount of, for example, from 0.1 to about 10 weight percent of toner, include carbon black, like REGAL 330® carbon black available from Cabot Corporation, PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED (Aldrich), Scarlet for THERMOPLAST NSD RED TM (Aldrich), Lithol Rubine Toner (Paul Uhlich), LITHOL SCARLET 4440 TM (BASF), BON RED C TM (Dominion Color), ROYAL BRILLIANT RED RD-8192 TM (Paul Uhlich), ORACET PINK RF (Ciba Geigy), PALIOGEN RED 3340 TM and 3871K TM (BASF), LITHOL FAST SCARLET L4300 TM (BASF), HELIOGEN BLUE D6840 TM, D7080 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), Irgalite Blue BCA (Ciba Geigy), PALIOGEN BLUE 6470 TM (BASF), SUDAN TM II, III and IV (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), Novoperm Yellow FGL (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1355 TM and D1351 TM (BASF), HOSTAPERM PINK E TM (Hoechst), FANAL PINK D4830 TM (BASF), Cinquasia Magenta (Dupont), PALIOGEN BLACK L0084 TM (BASF), PIGMENT BLACK K801 TM (BSSF) and carbon blacks such as REGAL 330® (Cabot), Carbon Black 5250 and 5750 (Columbian Chemicals). In embodiments the core may contain no magnetite, or no colorant, generally however at least one of the aforementioned pigments is present in the core.

Illustrative examples of suitable surfactants or stabilizers selected for the process of the present invention include poly(vinyl alcohols), partially hydrolyzed poly(vinyl alcohols), methyl cellulose, ethyl cellulose, hydroxypropyl cellulose, hydroxyethylmethyl cellulose, and the like. The effective concentration of surfactant in the aqueous medium ranges, for example, from about 0.1 percent by weight to about 5 percent by weight with the preferred amount being determined primarily by the nature of the toner precursor materials and the desired toner particle diameter size of, for example, 2 microns to about 20 microns. In embodiments, inorganic surfactants may also be utilized in combination with the organic surfactant for achieving a smaller microdroplet size of, for example, less than about 9 microns in average volume diameter. Illustrative specific examples of suitable inorganic surfactants include barium sulfate, lithium phosphate, tricalcium phosphate, potassium oleate, potassium caprate, potassium stearate, sodium laurate, sodium dodecyl sulfate, sodium oleate, sodium laurate, colloidal silica, and the like. The concentration of inorganic surfactant, that is effective in reducing the microdroplet size to below 9 microns, that is for example from about 3 to about 7 microns in embodiments ranges, for example, from about 0.005 to about 1.0 percent by weight, and preferably from about 0.01 to about 0.20 percent by weight.

For the shell-forming interfacial polycondensation, there can be selected two or more shell precursors or monomers, at least one of which is soluble in the microdroplet phase, and one in the aqueous phase. Shell formation results when the two shell monomers or precursors undergo polycondensation at the microdroplet/water interface. Exemplary shell materials include, for example, polyurea, polyurethane, polyester, polyamide and other condensation polymers, as illustrated in U.S. Pat. No. 4,877,706, the disclosure of which is totally incorporated herein by reference, and a number of the copending applications mentioned herein, and the like.

Exemplary shell monomers or precursors present in the microdroplet phase are polyisocyanates, polyacyl halides, polyhaloformates and the like, and which shells are preferably selected from the group consisting of polyisocyanates, such as benzene diisocyanate, toluene diisocyanate, diphenylmethane diisocyanate, hexamethylene diisocyanate, cyclohexane diisocyanate, bis(4-isocyanatocyclohexyl)methane, polymethylene polyphenylisocyanates, PAPI 27 TM, PAPI 135 TM, PAPI 94 TM, PAPI 901 TM, MONDUR MR TM, MONDUR MRS TM, MONDUR MRS-10 TM, modified diphenylmethane diisocyanates, ISONATE 143L TM, ISONATE 181 TM, ISONATE 191 TM, ISONATE 240 TM, MONDUR PF TM, and MONDUR XP-744 TM, modified toluene diisocyanates, MONDUR CB-60 TM, MONDUR CB-601 TM, MONDUR CB-75 TM, aliphatic polyisocyanates, DESMODUR W TM, DESMODUR N-75 TM, DESMODUR N-751 TM, DESMODUR N-100 TM, DESMODUR L-2291A TM, DESMODUR Z-4370 TM, DESMODUR Z-4370/2 TM, polyether Vibrathanes B-604, B-614, B-635, B-843, polyether isocyanate prepolymers E-21 or E-21A, XP-743, XP-744, and the like; polyacyl halides such as adipoyl chloride, fumaryl chloride, suberoyl chloride, succinyl chloride chloride, phthaloyl chloride, isophthaloyl chloride, terephthaloyl chloride; and polyhaloformates such as ethylene glycol bischloroformate, diethylene glycol bischloroformate, and triethylene bischloroformate. Exemplary water soluble shell monomers or precursors that can be added to the aqueous phase to initiate shell formation include polyamines such as ethylenediamine, tetramethylenediamine, pentamethylenediamine, hexamethylenediamine, p-phenylenediamine, m-phenylenediamine, hydroxytrimethylenediamine, methylpentamethylenediamine, diethylenetriamine, triethylenetetraamine, tetraethylenepentaamine, diaminooctane, xylylene diamine, bis(hexamethylene)triamine, tris(2-aminoethyl)amine, 4,4'-methylenebis(cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine; and polyols such as butanediol, hexanediol, bisphenol A, bisphenol Z, and the like. When desired, a water soluble crosslinking agent, such as triamine or triol, can also be added to improve the mechanical strength of the shell polymer. The thickness of the shell can generally be adjusted to be less than 2 micron, preferably to be less than 0.5 micron, and in embodiments from about 0.1 to about 0.5 micron, provided that the desired mechanical strength of the shell can be maintained. Interfacial polymerization processes selected for the shell formation of the toners of the present invention are as illustrated, for example, in U.S. Pat. Nos. 4,000,087 and 4,307,169, the disclosures of which are totally incorporated herein by reference.

Suitable free-radical initiators selected for the core resin-forming free radical polymerization include azo-type initiators such as 2,2'-azobis(dimethylvaleronitrile), azobis(isobutyronitrile), azobis(cyclohexanenitrile), azobis(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl-2,5-bis(2-ethylhexanoylperoxy)hexane, di-tert-butyl peroxide, cumene hydroperoxide, dichlorobenzoyl peroxide, and mixtures thereof, with the quantity of initiator being, for example, from about 0.1 percent to about 10 percent by weight of that of core monomer. Water-soluble free radical inhibitors can also be employed to suppress or inhibit emulsion polymerization in the aqueous phase. The emulsion polymerization in the aqueous phase, if uninhibited or unsuppressed, could result in the formation of unwanted emulsion-polymerized polymer particles, which would contaminate the desired encapsulated particle product. Illustrative examples of water-soluble free radical inhibitors include copper salts, ammonium thiocyanate, sodium nitrite, and the like. In situations where addition monomers with some solubility in water are utilized for the preparation of the core resin, it may be advantageous to dissolve an effective amount of metal salts such as potassium chloride, potassium sulfate, sodium chloride, sodium sulfate and the like, in the aqueous phase to suppress their solubility in water.

The silane treatment process is generally accomplished after the encapsulated toner particles have been formed. The encapsulated particles obtained after the free radical polymerization process can be first washed with water to remove the loosely attached surfactant molecules, and then treated with a silane reagent in the presence of an acid catalyst such as acetic acid or base catalyst such as an amine, preferably in an aqueous alcoholic medium. Specifically, the encapsulated particles can be stirred in an aqueous or aqueous alcohol medium, like methanol or ethanol, containing about 0.1 to about 15 weight percent of a suitable silane reagent. A catalytic amount of an amine or acid is generally utilized to increase the hydrolysis of the silane reagent, and its subsequent condensation reactions. Thereafter, the silane-treated encapsulated particles are washed again with water, and then dried at an elevated temperature ranging from about 40° C. to about 120° C. for an effective period of time of from about 1 to about 24 hours. The condensation or curing of the silane reagent is particularly facile at elevated temperatures. The resulting treated encapsulated particles can be isolated by either conventional spray or freeze drying methods. Other methods of silane treatment, such as for example spraying a mist of liquid silane reagent onto air suspended encapsulated particles in a fluidized bed at elevated temperatures, can also be employed. The silane-treated shell of the toners of present invention, comprising preferably of a condensation polymer such as polyurea, polyester or the like, coated or grafted with surfactant molecules containing a siloxane component generally have an effective thickness of, for example, from about 0.01 to over 2 microns, and about 5 microns in embodiments.

Illustrative examples of suitable silane reagents that can be selected for treating, or reacting with the shell of the present invention include methyltrimethoxysilane, ethyltrimethoxysilane, propyltrimethoxysilane, butyltrimethoxysilane, hexytrimethoxysilane, amyltriethoxysilane, cyclohexymethyltrichlorosilane, dodecyltriethoxysilane, decyltrichlorosilane, phenyltrimethoxysilane, 2-cyanoethyltriethoxysilane, 3-bromopropylmethyldimethoxysilane, 3-aminopropylmethyldiethoxysilane, 3-aminopropyldimethylethoxysilane, 3-aminopropyltrimethoxysilane, 3-aminopropyltriethoxysilane, 4-aminobutyltrimethoxysilane, 4-aminobutyltriethoxysilane, 3-(2-aminoethylamino)propyltrimethoxysilane, hexamethyldisilazane, 3-(6-aminohexylamino)propyltrimethoxysilane, 3-aminopropyltris(trimethylsiloxy)silane, 1,2-bis(trimethoxysilyl)ethane, 1,6-bis(trimethoxysilyl)hexane, 1,5-dichlorohexamethyltrisiloxane, 1,7-dichlorooctamethyltetrasiloxane, and 3-(N,N-dimethylamino)propyltrimethoxysilane.

Surface additives can be selected for the toners of the present invention including, for example, metal salts, metal salts of fatty acids, colloidal silicas, powdered metal oxides, mixtures thereof, and the like, which additives may be present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred additives include zinc stearate, AEROSIL R972 ® and powdered metal oxides.

In embodiments, known charge control or conductive additives can be applied to the surface of toners to control, respectively, their triboelectric and electroconductive characteristics. Illustrative examples of charge control additives include powdered conductive metal oxides, quaternary ammonium salts, organometallic complexes or salts of salicylic acids and catechols, and the like. Exemplary conductive additives include carbon blacks, graphites, conductive metal oxides, and the like. The aforementioned components can be present in various effective amounts, such as for example from about 0.1 to about 3 weight percent.

For two component developers, known carrier particles including steel ferrites, copper zinc ferrites, and the like, with or without coatings, can be admixed with, for example, from about 1 to about 5 parts of toner per about 100 parts of carrier with the encapsulated toners of the present invention, reference for example the carriers illustrated in U.S. Pat. Nos. 4,937,166; 4,935,326; 4,883,736; 4,560,635; 4,298,672; 3,839,029; 3,847,604; 3,849,182; 3,914,181; 3,929,657 and 4,042,518, the disclosures of which are totally incorporated herein by reference.

The encapsulated toners of the present invention can be utilized in various imaging systems as mentioned herein including, more specifically, those wherein latent images are developed on an imaging member and subsequently transferred to a supporting substrate and affixed thereto by cold pressure rollers, heat and/or a combination of heat and pressure.

The following examples are being submitted to further define various species of the present invention. These examples are intended to be illustrative only and are not intended to limit the scope of the present invention.

EXAMPLE I

A 14.7 micron (average diameter) pressure fixable black encapsulated toner treated with 3-aminopropyltrimethoxysilane was prepared as follows:

A mixture of 120 grams of lauryl methacrylate (available as ROCRYL 320 TM from Rohm and Haas), 13.0 grams of methacryloxypropyl terminated polydimethylsiloxane with a viscosity of from about 1,500 to about 2,500 centistokes (obtained from Huls America Inc.), 3.30 grams each of 2,2'-azobis-(2,4-dimethylvaleronitrile) and 2,2'-azobis-(isobutyronitrile), and a solution of 47.1 grams of ISONATE 143 TM in 20 milliliters of dichloromethane was mixed in a 2 liter Nalgene container with a Brinkmann polytron equipped with a PT 35/4 probe at 4,000 RPM for 30 seconds. Two hundred and eighty (280) grams of Northern Pigments magnetite NP-M TM was then added, and the resulting mixture was homogenized using the same Brinkmann polytron operating at 8,000 RPM for 3 minutes. To the mixture was then added 1 liter, 0.20 percent, of aqueous poly(vinyl alcohol) (88 percent hydrolyzed; MW, molecular weight average of 96,000) solution, and thereafter, the mixture was blended at 9,000 RPM with an IKA polytron equipped with a T45/4G probe for 2 minutes. A solution of 37 milliliters of 1,4-bis(3-aminopropyl)piperazine in 80 milliliters of water was then added with constant stirring for 10 minutes to initiate the shell forming interfacial polymerization. Subsequently, the mixture was transferred to a 3 liter reaction kettle and was mechanically stirred at room temperature for approximately 1 hour to complete the interfacial polymerization. The mixture was then heated in an oil bath with the temperature of the mixture being gradually raised from room temperature to a final temperature of 85° C. over a period of 1 hour. Heating was continued at this temperature for an additional 6 hours before the mixture was cooled down to room temperature, about 25° C. The resulting encapsulated toner product was washed with water until the washing was clear, and the toner product resulting was sieved through a 180 micron sieve to remove coarse material. Thereafter, the encapsulated toner particles were stirred in 1 liter, 30 percent (by volume), of an aqueous methanol solution containing 20 grams of 3-aminopropyltrimethoxysilane for 30 minutes, and then washed with water. Subsequently, 23.5 grams of colloidal graphite (AQUADAG E TM from Acheson Colloids) in 100 milliliters of water were added to the silane-treated toner encapsulated particles in 2 liters of water, and the mixture was then spray dried in a Yamato Spray Dryer at an air inlet temperature of 160° C., and an air outlet temperature of 80° C. A total of 360.0 grams of encapsulated toner product was obtained; the toner's volume average particle diameter, as measured on a 256 channel Coulter Counter, was 14.7 microns with a volume average particle size distribution of 1.31.

Two hundred and forty (240) grams of the above prepared encapsulated toner were dry blended using a Greey blender, first with 0.96 gram of carbon black (BLACK PEARLS 2000 TM) for 2 minutes with the blending impeller operating at 3,500 RPM, and then with 3.6 grams of zinc stearate for another 6 minutes at an impeller speed of 3,000 RPM. The latter blending was continued until the volume resistivity, as determined in a bench fixture with two electrodes therein connected to a power source, of toner was in the range of $5\times10^4$ to $5\times10^6$ ohm-cm. For this particular toner, the final volume resistivity was $1.5\times10^5$ ohm-cm as measured in a cell test fixture with two electrodes connected to a power source. After dry blending, the toner was further sieved through a 63 micron sieve. The toner prepared according to the above procedure was evaluated in a Delphax S6000 TM printer at a transfix pressure of 2,000 psi. For this toner, the image fix level was 91 percent, as determined by the known Scotch Tape ® test, and no image smear and no image ghosting were observed after 10,000 prints.

EXAMPLE II

A 7.4 micron magenta electrophotographic encapsulated toner treated with 3-(2-aminoethylamino)propyltrimethoxysilane was prepared as follows:

A mixture of 85.0 grams each of n-butyl methacrylate and isobutyl methacrylate, and 5.5 grams of FANAL PINK L TM pigment were ball milled for 24 hours. To this mixture were added 4.5 grams of 2,2'-azobis-(isobutyronitrile), and 3.0 grams of ISONATE 143L TM, and the mixture was roll blended until all the free radical initiator was dissolved. One hundred and fifty (150) grams of the resulting mixture were transferred to a 2 liter reaction vessel containing 700 milliliters, 1.0 percent, of an aqueous hydroxyethylmethyl cellulose solution, and was homogenized for 2 minutes using a Brinkmann polytron operating at 10,000 rpm. Thereafter, 1.5 grams of 2-methylpentamethylenediamine were added, and the resulting mixture was mechanically stirred at room temperature for 30 minutes. Subsequently, the reaction mixture was heated to 80° C. over a period of 1 hour, and retained at this temperature for another 10 hours before cooling it down to room temperature. The resulting encapsulated toner product was washed repeatedly with water until the aqueous phase was clear in color, and this toner product was then stirred in 500 milliliters, 20 percent (by volume), of aqueous methanol solution containing 10 grams of 3-(2-aminoethylamino)propyl-trimethoxysilane for 30 minutes. Thereafter, the resulting mixture was centrifuged, and the supernatant was decanted off. The particle residue was washed with water, and centrifuged again to facilitate the separation of the encapsulated toner particles from water. The washing was repeated twice before the encapsulated toner particles were spray dried in a Yamato Spray Dryer at an air inlet temperature of 160° C., and an air outlet temperature of 80° C. The resulting encapsulated toner particles evidenced a volume average particle diameter of 7.4 microns, and a volume average particle size distribution of 1.26 according to Coulter Counter measurements.

Fifty (50.0) grams of the above prepared encapsulated toner particles were dry blended with a mixture of 0.20 gram of AEROSIL R812 TM and 0.30 gram of conductive tin oxide powder for 10 minutes using a Greey blender with its blending impeller operating at 2,500 rpm. The toner exhibited excellent powder flow characteristics. A negatively charged developer was prepared by blending 2 parts by weight of the encapsulated particles obtained with 98 parts by weight of Xerox Corporation 9200 TM carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. The toner displayed a triboelectric value of −18.4 microcoulombs per gram as determined in a Faraday Cage apparatus. Also, it is believed that excellent images can be generated with the aforementioned developer, and wherein the latent images are initially formed in an experimental xerographic imaging device with an amorphous selenium-based photoconductive imaging member, and subsequent to the development of images with the aforementioned prepared toner the images can be transferred to a paper substrate and fixed with heat, about 160° C., with a VITON ® fuser roll.

EXAMPLE III

A 15.1 micron pressure fixable encapsulated toner treated with 3-aminopropyltrimethoxysilane was prepared as follows:

In a 2 liter Nalgene container were discharged lauryl methacrylate (120 grams), VAZO-52 TM initiator (3.0 grams), VAZO-64 TM initiator (3.0 grams), Araldite GY 306 (8.4 grams, from Ciba-Geigy), ISONATE 143L TM (39.0 grams) and dichloromethane (20 milliliters). The mixture was blended with an IKA polytron at 4,000 rpm for 30 seconds, followed by addition of BAYFERROX TM 8610 magnetite (300 grams). The mixture was blended again at 8,000 rpm for 3 minutes before homogenizing in 1 liter of 0.08 percent aqueous poly(vinyl alcohol) (88 percent hydrolyzed, $M_w$=96,000) solution at 9,000 rpm for 2 minutes. The resulting suspension was transferred to a 2 liter kettle and mechanically stirred at room temperature while an aqueous solution of 37 milliliters of 1,4-bis(3-aminopropyl)piperazine in 80 milliliters of water was added. After 1.5 hours of stirring at room temperature, about 25° C., the reaction mixture was heated to 90° C. over a period of 1 hour, and then held at this temperature for 5 hours before cooling down to room temperature. The supernatant of the mixture was decanted off, and the encapsulated particles were washed with water until the supernatant was clear. Thereafter, the encapsulated toner particles were treated with 3-aminopropyltrimethoxysilane and Aquadag E TM, and then spray dried in accordance with the procedure of Example I. A total of 312.0 grams of black encapsulated toner particles were obtained; the toner's volume average particle diameter was 15.1 microns with a volume average particle size distribution of 1.31 according to Coulter Counter measurements. The toner particles were dry blended, and tested in accordance with the procedure of Example I, and substantially similar results were obtained.

EXAMPLE IV

A 4.7 micron yellow electrophotograhic toner treated with 3-aminopropyltriethoxysilane was prepared by the following procedure.

A mixture of 80 grams of isobutyl methacrylate, 10.0 grams of poly(butyl methacrylate), 6.5 grams of Sicofast Yellow pigment, and 10 milliliters of methylene chloride was ball milled for 24 hours. To this mixture were added 3.0 grams of 2,2'-azobis-(isobutyronitrile), and 8.0 grams of ISONATE 143L TM, and the mixture was roll blended until all the free radical initiator was dissolved. The mixture was added to 500 milliliters, 1.0 percent, of an aqueous hydroxyethylmethyl cellulose solution containing 0.65 gram of sodium dodecyl sulfate in a 2 liter reaction vessel, and homogenized for 1 minute using a Brinkmann polytron operating at 10,000 rpm. Thereafter, 2.0 grams of 2-methylpentamethylenediamine were added, and the resulting mixture was mechanically stirred at room temperature for 30 minutes. Subsequently, the reaction mixture was heated to 85° C. over a period of 1 hour, and maintained at this temperature for another 8 hours before cooling it down to room temperature. The resulting toner particle product was washed with water until the aqueous phase was clear, and was then stirred in 500 milliliters, 10 percent, of an aqueous ethanol solution containing 10 grams of 3-aminopropyltriethoxysilane for 20 minutes according to the procedure of Example II. The resulting toner particles evidenced a volume average particle diameter of 4.7 microns, and a particle size distribution of 1.29 according to Coulter Counter measurements.

Fifty grams of the toner obtained were dry blended with 1.0 gram of powdered BONTRON E-88 TM, an aluminum salt charge additive obtained from Orient Chemical Company of Japan, and a negatively charged developer was prepared by repeating the procedure of Example II. The toner displayed a triboelectric value of −16.8 microcoulombs per gram.

The triboelectric values reported herein were measured in a Faraday Cage apparatus unless otherwise indicated.

EXAMPLE V

A 6.8 micron cyan electrophotographic encapsulated toner treated with 3-aminopropyltrimethoxysilane was prepared as follows:

A mixture of 146 grams of isobutyl methacrylate, 37 grams of lauryl methacrylate, and 3.0 grams of HELIOGEN BLUE TM pigment was ball milled for 24 hours. To this mixture were added 3.0 grams each of 2,2'-azobis-(2,4-dimethylvaleronitrile) and 2,2'-azobis-(isobutyronitrile), and 3.2 grams of DESMODUR W TM, and the mixture was roll blended until all the free radical initiators were dissolved. One hundred and fifty (150) grams of the resulting mixture were transferred to a 2 liter reaction vessel containing 700 milliliters, 1.0 percent, of an aqueous hydroxyethylmethyl cellulose solution, and the resulting mixture was homogenized for 2 minutes using a Brinkmann polytron operating at 10,000 rpm. Thereafter, 2.0 grams of 1,4-bis(3-aminopropyl)piperazine were added, and the mixture was mechanically stirred at room temperature for 30 minutes. Subsequently, the mixture was heated to 80° C. over a period of 1 hour, and retained at this temperature for another 10 hours before cooling it down to room temperature. The resulting encapsulated particles were washed with water, and treated with 3-aminopropyltrimethoxysilane in accordance with the procedure of Example II. The encapsulated toner product obtained evidenced a volume average particle diameter of 6.8 microns, and a particle size distribution of 1.32 according to Coulter Counter measurements.

Fifty (50.0) grams of the silane-treated encapsulated toner product was dry blended with a mixture of 0.20 grams of AEROSIL R812 ® and 0.30 gram of conductive tin oxide powder for 10 minutes using a Grey blender with its blending impeller operating at 2,500 rpm. A negatively charged developer was prepared by blending 2 parts by weight of the encapsulated particles obtained with 98 parts by weight of Xerox Corporation 9200 TM carrier particles. The toner displayed a triboelectric value of −18.4 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device of Example II, and subsequent to the development of images with the aforementioned prepared encapsulated toner the images were transferred to a paper substrate and fixed with heat, about 160° C., with a Viton fuser roll.

Other modifications of the present invention may occur to those skilled in the art based upon a review of the present application and these modifications, including equivalents thereof, are intended to be included within the scope of the present invention.

What is claimed is:

1. An encapsulated toner composition consisting essentially of a core of a polymer resin, pigment particles, and thereover a polymer shell coated with a siloxane component obtained from the hydrolysis and subsequent condensation on the shell surface of a silane selected from the group consisting of methyltrimethoxysilane, ethyltrimethoxysilane, propyltrimethoxysilane, butyltrimethoxysilane, hexytrimethoxysilane, amyltriethoxysilane, cyclohexymethyltrichlorosilane, dodecyltriethoxysilane, decyltrichlorosilane, phenyltrimethoxysilane, 2-cyanoethyltriethoxysilane, 3-bromopropylmethyldimethoxysilane, 3-aminopropylmethyldiethoxysilane, 3-aminopropyldimethylethoxysilane, 3-aminopropyltrimethoxysilane, 3-aminopropyltriethoxysilane, 4-aminobutyltrimethoxysilane, 4-aminobutyltriethoxysilane, 3-(2-aminoethylamino)propyltrimethoxysilane, hexamethyldisilazane, 3-(6-aminohexylamino)propyltrimethoxysilane, 3-aminopropyltris(trimethylsiloxy)silane, 1,2-bis(trimethoxysilyl)ethane, 1,6-bis(trimethoxysilyl)hexane, 1,5-dichlorohexamethyltrisiloxane, 1,7-dichlorooctamethyltetrasiloxane, and 3-(N,N-dimethylamino)propyltrimethoxysilane.

2. An encapsulated toner in accordance with claim 1 wherein the siloxane component is chemically attached to the shell polymer.

3. An encapsulated toner in accordance with claim 1 wherein the core polymer resin is an addition polymer.

4. An encapsulated toner in accordance with claim 1 wherein the shell polymer is selected from the group consisting of polyurea, polyester, polyurethane, polyamide, and mixtures thereof.

5. An encapsulated toner in accordance with claim 3 wherein the core polymer is selected from the group consisting of styrene, acrylate, and methacrylate polymers.

6. An encapsulated toner in accordance with claim 1 wherein the core polymer is derived from polymerization of monomer or monomers selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, methylstyrene, hexylstyrene, dodecylstyrene, and nonyl styrene.

7. A toner in accordance with claim 1 wherein the polymer core resin comprises from about 20 to about 98 percent by weight of toner, the pigment comprises from about 1 to about 60 percent by weight of toner, the shell polymer shell comprises from about 0.01 to about 20 percent by weight of toner, and the siloxane component comprises from about 0.001 to about 10 percent by weight of the toner.

8. A toner in accordance with claim 1 containing surface additives.

9. A toner in accordance with claim 8 wherein the surface additives are selected from the group consisting of conductive metal oxides, metal salts, metal salts of fatty acids, colloidal silica, quaternary ammonium salts, sulfonamides, sulfonimides, organometallic complexes and the salts thereof, and mixtures thereof.

10. A toner in accordance with claim 9 wherein conductive tin oxide powder and zinc stearate are selected.

11. A toner in accordance with claim 9 wherein conductive tin oxide powder and colloidal silica are selected.

12. A toner in accordance with claim 8 wherein the additives are present in an amount of from about 0.1 to about 10 weight percent of the toner.

13. A toner in accordance with claim 1 wherein the polymer shell is formed by interfacial polymerization, and the core resin is formed by free radical polymerization.

14. A toner in accordance with claim 1 wherein the toner contains charge control additives.

15. A toner in accordance with claim 14 wherein the charge control additives are selected from the group consisting of quaternary ammonium salts, colloidal silicas, metal oxides, sulfonamides, sulfonimides, organometallic complexes, and mixtures thereof.

16. A toner in accordance with claim 1 wherein colloidal graphite is further incorporated into the toner shell and wherein there is dispersed in the toner shell carbon black particles.

17. A process for the preparation of encapsulated toner compositions which comprises forming a stable oil-in-water microdroplet suspension in an aqueous medium containing a surfactant; effecting a shell-forming interfacial polycondensation, followed by a core resin-forming free radical polymerization within the newly formed microcapsules, thereby converting the microdroplets into encapsulated particles; treating the encapsulated particles with a suitable silane reagent; and thereafter optionally applying optional surface additives to the silane-treated encapsulated particles.

18. A process in accordance with claim 17 wherein the free radical polymerization is accomplished at a temperature of from about 35° C. to about 120° C.

19. An imaging process which comprises the generation of an image on an imaging surface, subsequently developing this image with the toner composition of claim 1, thereafter transferring the image to a suitable substrate, and permanently affixing the image thereto.

20. An imaging method in accordance with claim 19 wherein fixing is accomplished by heat.

21. An imaging method in accordance with claim 19 wherein fixing is accomplished by pressure and heat.

22. A toner composition in accordance with claim 1 wherein combined thickness of the polymer shell and the siloxane component is from about 0.001 to about 2 microns.

23. An encapsulated toner in accordance with claim 1 wherein the pigment particles are selected from the group consisting of magnetites, cyan, yellow, magenta, red, green, blue, brown, and mixtures thereof.

* * * * *